US007839726B2

(12) United States Patent
Winkler

(10) Patent No.: US 7,839,726 B2
(45) Date of Patent: Nov. 23, 2010

(54) TIMEPIECE INCLUDING OPTICAL GUIDE WHICH PERFORMS THE FUNCTION OF A CRYSTAL

(75) Inventor: Pascal Winkler, Saint-Blaise (CH)

(73) Assignee: Asulab S.A., Marin (CH)

( * ) Notice: Subject to any disclaimer, the term of this patent is extended or adjusted under 35 U.S.C. 154(b) by 228 days.

(21) Appl. No.: 11/720,790

(22) PCT Filed: Nov. 11, 2005

(86) PCT No.: PCT/EP2005/055929

§ 371 (c)(1),
(2), (4) Date: Jun. 4, 2007

(87) PCT Pub. No.: WO2006/058835

PCT Pub. Date: Jun. 8, 2006

(65) Prior Publication Data

US 2009/0109801 A1 Apr. 30, 2009

(30) Foreign Application Priority Data

Dec. 2, 2004 (EP) ..... 04028559

(51) Int. Cl.
*G04B 19/30* (2006.01)

(52) U.S. Cl. ..... 368/67; 368/223; 368/227; 368/296

(58) Field of Classification Search ..... 368/67, 368/79, 226–227, 239–242, 285, 294, 296, 368/234; 40/442–444
See application file for complete search history.

(56) References Cited

U.S. PATENT DOCUMENTS 1,930,359 A 10/1933 Hildenberg (Continued)

FOREIGN PATENT DOCUMENTS

BE 498065 1/1951

(Continued)

OTHER PUBLICATIONS

International Search Report issued in corresponding application No. PCT/EP2005/055929 completed Sep. 25, 2006 and mailed Oct. 5, 2006.

(Continued)

*Primary Examiner*—Vit W Miska
*Assistant Examiner*—Sean Kayes
(74) *Attorney, Agent, or Firm*—Griffin & Szipl, P.C.

(57) ABSTRACT

A timepiece (40) includes optical means for forming a decorative pattern, in the form of a figurative image, in response to user action. The optical means forming a figurative image include an optical guide (1, 51) having two large faces (10, 11) and at least one lateral face (12). Optical extractors (19), each having at least one light reflective surface (20), are arranged in at least one of the large faces (11). A light source (8, 8*a*, 8*b*, 8*c*) is arranged so as to emit light in the direction of the reflective surfaces (20), via the lateral face (12) of the optical guide. Thus, each of the reflective surfaces causes a reflected light beam to form in a well defined direction, and the set of light beams forms a figurative image in that direction, which can typically be selected as the normal with respect to the mid-plane of the watch.

16 Claims, 5 Drawing Sheets

U.S. PATENT DOCUMENTS

| | | | | | |
|---|---|---|---|---|---|
| 2,290,278 | A | * | 7/1942 | Failla | 368/234 |
| 2,290,750 | A | * | 7/1942 | Howe et al. | 368/234 |
| 2,916,871 | A | * | 12/1959 | Wegner | 368/67 |
| 3,490,226 | A | * | 1/1970 | Anderson et al. | 368/67 |
| 3,899,871 | A | * | 8/1975 | Kitai | 368/227 |
| 4,250,575 | A | * | 2/1981 | Flumm | 368/227 |
| 4,541,727 | A | * | 9/1985 | Rosenthal | 368/232 |
| 4,761,715 | A | * | 8/1988 | Brooks | 362/23 |
| 4,834,475 | A | | 5/1989 | Robinson | |
| 4,992,704 | A | | 2/1991 | Stinson | |
| 4,999,822 | A | | 3/1991 | Blackburn | |
| 5,400,304 | A | * | 3/1995 | Offenstein | 368/285 |
| 5,743,616 | A | | 4/1998 | Giuliano et al. | |
| 5,984,485 | A | * | 11/1999 | Poli et al. | 362/26 |
| 6,452,872 | B1 | * | 9/2002 | Teijido et al. | 368/67 |
| 6,463,012 | B1 | * | 10/2002 | Bar-Yona | 368/80 |
| 6,473,554 | B1 | | 10/2002 | Pelka et al. | |
| 6,690,623 | B1 | * | 2/2004 | Maano | 368/82 |
| 6,745,506 | B2 | | 6/2004 | Maas et al. | |
| 6,806,644 | B2 | * | 10/2004 | Ueno et al. | 313/512 |
| 7,038,975 | B2 | * | 5/2006 | Ferri et al. | 368/67 |
| 7,038,976 | B2 | * | 5/2006 | Winkler et al. | 368/67 |
| 7,128,460 | B2 | | 10/2006 | Hosobuchi | |
| 2004/0213088 | A1 | * | 10/2004 | Fuwausa | 368/228 |

FOREIGN PATENT DOCUMENTS

| | | |
|---|---|---|
| BE | 671105 | 4/1966 |
| EP | 0 282 934 | 9/1988 |
| EP | 0 616 922 A1 | 9/1994 |
| EP | 0 786 685 | 7/1997 |
| FR | 992.254 | 10/1951 |
| JP | 58075085 | 5/1983 |
| JP | 8-271650 | 10/1996 |
| WO | 2004/055559 | 7/2004 |
| WO | 2004/097773 | 11/2004 |

OTHER PUBLICATIONS

International Search Report issued related application No. PCT/EP2005/055928 completed Jun. 9, 2006 and mailed Jun. 19, 2006.

Office Action issued in co-pending related U.S. Appl. No. 11/720,797, mailed Jun. 19, 2009.

Office Action dated Jan. 27, 2010 in co-pending related U.S. Appl. No. 11/720,797.

Office Action dated Jan. 14, 2010 in co-pending related U.S. Appl. No. 11/720,804.

McGraw-Hill Dictionary of Scientific and Technical Terms 1133 (1978), previously filed Aug. 12, 2009 as "Exhibit A".

Warren J. Smith, Modern Optical Engineering 281-285 (McGraw-Hill Companies, Inc. 2000), previously filed Aug. 12, 2009 as "Exhibit B".

Physics 787 (W.W. Norton & Company, Inc. 1985), previously filed Aug. 12, 2009 as "Exhibit C,".

Encyclopedia of Laser Physics and Technology, http://www.rp-photonics.com/waveguides.html, downloaded Sep. 23, 2009, 5 pages, previously filed Oct. 6, 2009 as "Exhibit D".

http://www.rpi.edu/dept/phys/Dept2/APPhys1/optics/optics/node4.html, downloaded Sep. 23, 2009, four pages, previously filed Oct. 6, 2009 as "Exhibit E".

"Refractive Index List of Substances—Table of Refraction Indices" downloaded from www.robinwood.com, on Sep. 23, 2009, two pages, previously filed Oct. 6, 2009 as "Exhibit F".

Webster'S Ninth New Collegiate Dictionary (1990) pp. 823-824, filed herewith as "Exhibit G".

* cited by examiner

Fig. 2bis

TIMEPIECE INCLUDING OPTICAL GUIDE WHICH PERFORMS THE FUNCTION OF A CRYSTAL

This is a National Phase Application in the United States of International Patent Application No. PCT/EP2005/055929 filed Nov. 11, 2005, which claims priority on European Patent Application No. 04028559.5, filed Dec. 2, 2004. The entire disclosures of the above patent applications are hereby incorporated by reference.

FIELD OF THE INVENTION

The present invention concerns a timepiece including a case closed by a crystal and inside which there is housed an optical device for forming a figurative image visible through the crystal.

BACKGROUND OF THE INVENTION

Timepieces of this type are known from the prior art. By way of example, EP Patent Application No. 0 786 685, filed on 16 Jan. 1997 in the name of SMH Management Services AG, discloses a timepiece comprising a device displaying a coloured decorative pattern. This document implements an optical valve located between a film on which the decorative pattern is printed and the timepiece crystal. When the optical valve is not being supplied with electrical energy, it appears black whereas when it is being powered, it becomes transparent thus making the decorative pattern visible.

This system has, however, a certain number of drawbacks, including in particular high manufacturing cost. The optical valve is preferably made in the form in a liquid crystal cell carrying transparent electrodes on each of its main faces for polarising the liquid crystals. Thus, deposition of the electrodes on the cell faces requires a method whose cost is not negligible, in particular if the optical system is to be implemented in a device for the general public at a low cost price. Moreover, this optical system is very complex in terms of electrical connections as regards the electrical powering of the liquid crystal control electrodes.

SUMMARY OF THE INVENTION

It is an object of the present invention to overcome the aforementioned drawbacks of the prior art by supplying a device, particularly for a timepiece, for displaying a decorative pattern that can be implemented at a lower cost.

The invention therefore provides in particular a timepiece of the aforementioned type characterized in that the optical device further includes a first optical guide with two large faces and at least one lateral face, a plurality of extractors being arranged on one of the large faces, each of the extractors having predefined geometrical features including at least one reflective surface. The optical device according to the present invention further includes at least one light source arranged facing the lateral face in a predefined direction to emit light inside the optical guide and cooperate with the reflective surfaces to form the figurative image directly defined as a function of the geometrical features of the extractors, by reflecting light onto the reflective surfaces.

Alternatively, the optical extractors could each include at least one refractive surface, as the light extractor surface, instead of the reflective surface.

The invention proposes in particular a timepiece including a case closed by a crystal, and inside which there is housed an optical device for forming at least one figurative image through the crystal, the optical device including, on the one hand, at least one optical guide having two large faces and at least one lateral face and, on the other hand, at least one light source, which emits light inside the optical guide, of the type in which the light emitted by the light source cooperates with optical extractors that are arranged on one of the large faces to form the figurative image, characterized in that the light source is arranged in proximity to the lateral face and oriented in a predefined direction to emit light inside the optical guide, in that each optical extractor has predefined geometrical features, including at least one reflective or refractive surface, such that the set of light beams emitted by the light source which are reflected or refracted respectively, by the optical extractors forms a light beam network which generates the figurative image, and in that the optical guide performs the function of a crystal.

Other advantageous features of the electronic device according to the invention are defined in the claims of the present application.

The optical guide according to the present invention can be arranged on the dial of the timepiece, can fulfil the function of a dial, alternatively, or be made directly in the timepiece crystal.

Preferably, the light source is arranged at the periphery of the case so that it is not visible through the crystal, for obvious aesthetic reasons.

Owing to the aforementioned features, the timepiece according to the invention has an attractive appearance for the user because the decorative pattern, or figurative image, thereby obtained is illuminated when the light source is being powered, whereas the optical guide is almost invisible when the light source is not being powered.

A large number of variants of the aforementioned optical device can advantageously be devised.

In particular, a multi-coloured figurative image could be formed by implementing a plurality of groups or networks of extractors in the optical guide, each group of extractors being associated with its own light source.

Moreover, single coloured or multi-coloured animated patterns could be displayed, on the basis of the aforementioned variant, by powering the light sources sequentially.

The various extractor groups could be arranged in different areas of the optical guide or be interlaced in the same area. Alternatively or by way of complement, two or more optical guides could be superposed, each of the optical guides carrying at least one group of extractors.

Thus, in accordance with a first non-limiting embodiment of the invention, a timepiece is provided that includes a case closed by a crystal, and inside which there is housed an optical device for forming at least one figurative image through the crystal, the optical device including, on the one hand, at least one optical guide having two large faces and at least one lateral face and, on the other hand, at least one light source, which emits light inside the optical guide, of the type in which the light emitted by the light source cooperates with optical extractors that are arranged on one of the large faces to form the figurative image, wherein the light source is arranged in proximity to the lateral face and oriented in a predefined direction to emit light inside the optical guide, wherein each optical extractor has predefined geometrical features, including at least one reflective or refractive surface, such that the set of light beams emitted by the light source which are reflected or refracted respectively, by the optical extractors forms a light beam network which generates the figurative image, and wherein the optical guide performs the function of a crystal.

In accordance with a second non-limiting embodiment of the invention, a timepiece according to the first embodiment is modified so that the light source is arranged facing the lateral face in a predefined direction for emitting light inside the optical guide and cooperating with the reflective or refractive surfaces to form the figurative image. In accordance with a third non-limiting embodiment of the invention, the first embodiment is modified so that the light source is oriented in an orthogonal direction to one of the large faces. In accordance with a fourth non-limiting embodiment of the present invention, the first embodiment is modified so that the optical guide includes at least two groups of optical extractors corresponding to a first figurative image and a second group of optical extractors corresponding to a second figurative image. In accordance with a fifth non-limiting embodiment of the invention, the fourth embodiment is further modified so that the second group of optical extractors is arranged in a second optical guide superposed onto the first optical guide. In accordance with a sixth non-limiting embodiment of the invention, the fifth embodiment is further modified so that the light source is arranged so as to emit light simultaneously in the first and second optical guides.

In accordance with a seventh non-limiting embodiment of the invention, the fourth embodiment is further modified so that the timepiece includes a first light source arranged for cooperating with the first group of optical extractors, and a second light source arranged for cooperating with the second group of optical extractors. In accordance with an eighty non-limiting embodiment of the invention, the fourth embodiment is further modified so that the timepiece includes a first light source arranged for cooperating with the first group of optical extractors, and a second light source arranged for cooperating with the second group of optical extractors and wherein the first and second groups of optical extractors are interlaced on the large face of the optical guide. In accordance with a ninth non-limiting embodiment of the present invention, the seventh embodiment is further modified so that the two light sources are powered sequentially.

In accordance with a tenth non-limiting embodiment of the present invention, the first embodiment is modified so that the timepiece includes a first light source and at least a second light source arranged for emitting light inside the optical guide along a different direction from the emission direction of the first light source, and additional means are provided for driving the optical guide in rotation such that the optical extractors cooperate alternately with the first and second light sources. In accordance with an eleventh non-limiting embodiment of the present invention, the first embodiment is modified so that each light source is capable of emitting light in several colour ranges. In accordance with a twelfth non-limiting embodiment of the invention, the seventh embodiment is further modified so that the respective colours of the first and second light sources belong to different ranges.

In accordance with a thirteenth non-limiting embodiment of the present invention, the first embodiment is modified so that the optical device includes at least two groups of optical extractors whose respective geometrical features are defined such that the associated figurative images are formed in different respective directions. In accordance with a fourteenth non-limiting embodiment of the present invention, the thirteenth embodiment is further modified so that the different figurative image forming directions are defined so as to form a stereogram. In accordance with a fifteenth non-limiting embodiment of the present invention, the first embodiment is modified so that the case has a bezel, and each light source is arranged at least partially underneath the bezel.

Other variants will be described in the following detailed description.

BRIEF DESCRIPTION OF THE DRAWINGS

Other features and advantages of the present invention will appear more clearly upon reading the following detailed description, made with reference to the annexed drawings, given by way of non-limiting example and in which:

FIG. 2*bis* is a similar view to that of FIG. 2 which shows a variant in which the light source is oriented orthogonally to one of the large faces of the light guide;

DETAILED DESCRIPTION

Figure 1:
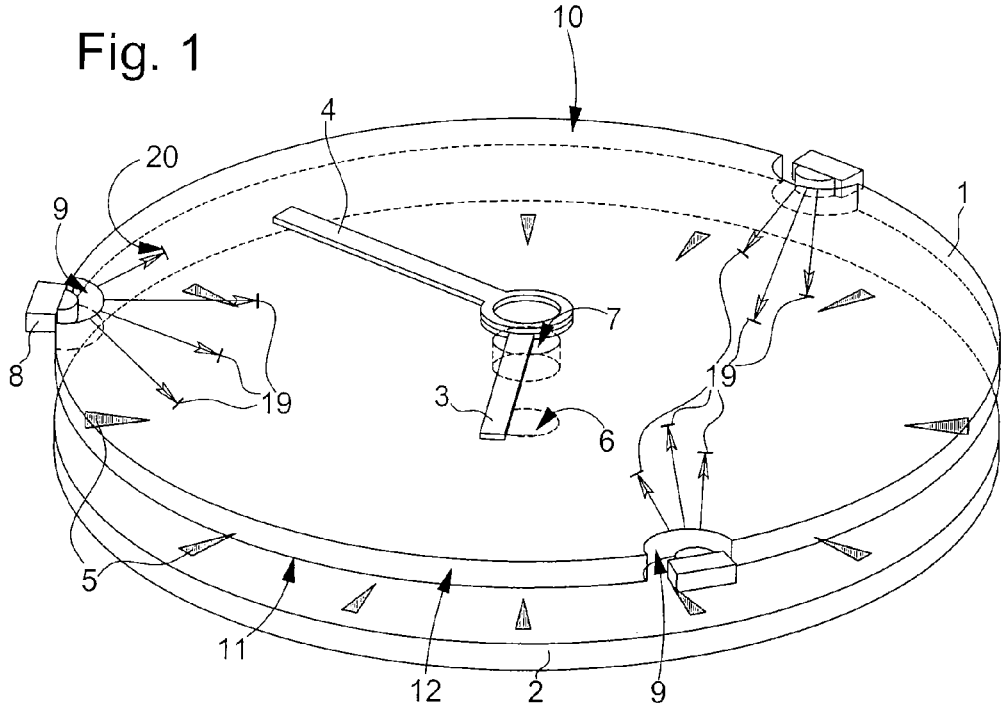
FIG. 1 shows an exploded perspective and schematic view of the display means of an analogue display timepiece according to a first preferred embodiment of the present invention.
Figure 2:
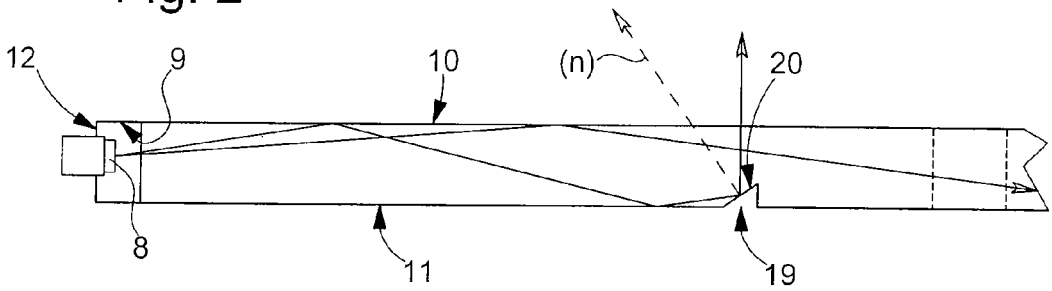
FIG. 2 shows a cross-section of the optical guide shown in FIG. 1.
Figure 2:
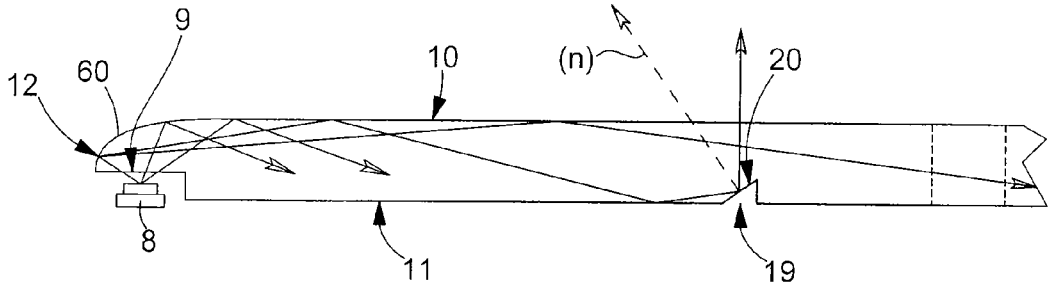

FIGS. 1 and 2 show schematic views respectively in perspective and cross-section of an optical guide 1 according to the present invention.

FIG. 1 shows a possible arrangement of optical guide 1 in a timepiece, namely between dial 2 and hour hand 3 and minute hand 4. Dial 2 and hands 3 and 4 are of a conventional type, dial 2 carrying hour symbols 5 for indicating the position of the hours.

The dial and the optical guide each include a central aperture respectively 6, 7, to allow drive means for hands 3 and 4 to pass, i.e. the hour wheel and the cannon-pinion (not shown in FIG. 1 for the sake of clarity).

In the embodiment shown in FIG. 1, optical guide 1 operates in collaboration with three identical, or possibly different coloured, diodes 8, in order to form a figurative image visible above dial 2 of the timepiece.

From the point of view of the basic principle, a single diode 8 is sufficient to form, in association with a network of optical extractors as described hereinafter, a figurative image.

Preferably, optical coupling between the light beams emitted by each of diodes 8 with optical guide 1 is accomplished through an entry surface 9. Entry surfaces 9 each have substantially the shape of a portion of cylindrical case, such that the beams emitted by the diodes are refracted at the entry into the optical guide. Thus, the angular aperture of each of the light beams is increased to cover most of the optical guide surface.

Optical guide 1 has two main large faces 10 and 11, shown in FIG. 1 substantially in the shape of discs by way of non-limiting illustration, connected to each other by a lateral face 12 that has the general shape of a ring. Light entry surfaces 9 are arranged in lateral surface 12.

The operating principle of the optical system described in relation to FIG. 1 is shown in a diagram in FIG. 2, in which optical guide 1 is shown alone in a transverse cross-section, along a plane intersecting one of diodes 8.

According to the present invention, optical guide 1 includes a plurality of optical extractors 19, only one of which is visible in FIG. 2, arranged on large face 11 located on the side of dial 2.

Optical extractors 19, each of which has at least one reflective surface 20, are distributed in accordance with a predefined network over large face 11, this network being defined to correspond to a very precise figurative image, as explained hereinafter.

Reflective surface 20 has a normal (n) oriented so as to face the corresponding diode 8, at a certain predefined angle. Thus, a certain proportion of the light beams emitted by diode 8 fall onto the reflective surface 20, either by direct incidence, or after one of several prior reflections on at least one of large faces 10 and 11.

The proportion of light beams that interact with reflective surface 20 can be adjusted as a function of certain geometrical parameters of a given extractor, in particular as a function of the distance separating diode 8 from reflective surface 20 and the height of optical extractor 19 in relation to the thickness of optical guide 1. Those skilled in the art will not encounter any particular difficulty in adapting these parameters in accordance with requirements.

First of all, as regards the most general embodiment of the timepiece according to the present invention, all of the optical extractors, provided to form a predefined figurative image, have the same angle with respect to large face 11. This features means that the light beams falling on reflective surface 20 of the network are all deviated in the same direction. Thus, each reflective surface 20 of the network gives rise to the formation of a reflected light beam. The set of reflected light beams form a network of reflected light beams giving rise to a figurative image in a given direction.

In the particular case shown in FIG. 2, the angle between reflective surface 20 and large face 11 is substantially 45 degrees, causing the formation of a figurative image in a direction substantially perpendicular to the large face. Thus, the person wearing the timepiece according to the invention can see a luminous image when he looks at the dial in a substantially normal direction, provided of course that diodes 8 are supplied with electric power.

Of course, the invention is not limited to forming a figurative image in a direction perpendicular to the dial. One could, for example, envisage forming the figurative image in a direction having an angle of the order of 60 degrees in relation to the dial, in the direction of the 6 o'clock position, to allow the user to see it without rotating his forearm to any great extent.

Generally, the direction in which the figurative image is formed is adjusted by the angle formed by the reflecting surface with respect to the incident light beams, the normal (n) of the reflecting surface corresponding to the bisecting line of the diode-reflecting surface direction on the one hand and the reflecting surface-observer direction on the other hand.

Optical guide 1 can be made of any material possessing the required qualities, including in particular transparency as regards light propagation, especially in the visible field. Preferably, the optical guide could be made of a plastic material of the PMMA type, by injection, replication, or by any other suitable method, the advantages of such solutions mainly residing in the corresponding easy manufacturing methods and in the low cost price of the product obtained.

After the preceding explanation, it will be understood that the reflecting surfaces 20 constitute a set of pixels for forming a figurative image. Consequently, the smaller the size of the reflecting surfaces, the better the image resolution and quality.

As already suggested, it should be noted that the higher the optical extractor, the larger its efficient surface and thus, the greater the quantity of light extracted from the optical guide at the corresponding location. Thus, as a result, the luminous intensity of each of the reflected light beams can be finely adjusted via the features of the corresponding optical extractor. On the basis of this adjustment, it becomes possible to form a "grey level" figurative image (in the colour of the diode used) on the basis of a single light source.

Using current manufacturing techniques, it is possible to envisage making optical extractors having dimensions of the order of 10 μm. Moreover, the reflective surface 20 can have various shapes, flat or curved to modulate the form of the reflected beam and make it slightly divergent for example.

Preferably, the optical extractors belonging to the same network have at least one common geometrical feature, namely that the normal to its reflecting surface is contained in a plane which is perpendicular both to optical guide 1 and to the corresponding entry surface 9. This feature that is shown in a diagram in FIG. 1 guarantees that light extraction is optimum, which is more advantageous from the electric energy consumption point of view of the timepiece in which the light decoration of the present invention is implemented.

The structure shown in FIG. 1, implementing an optical guide 1 illuminated by three light sources advantageously allows a multi-coloured image to be formed.

For this purpose the light sources emit light radiations of different respective colours, each of the sources being associated with its own optical extractor network.

According to a simple variant, each of the three optical extractor networks can be arranged in an area of optical guide 1 located in proximity to the diode 8 associated therewith, as shown in the diagram of FIG. 1.

Alternatively, each of the three networks can be spread over a large part of the total optical guide surface, possibly interlaced with each other. An example of a figurative image obtained with this configuration is described hereinafter, in relation to the detailed description of FIGS. 3*a*, 3*b*, 3*c* and 3*d*.

Figure 3A:
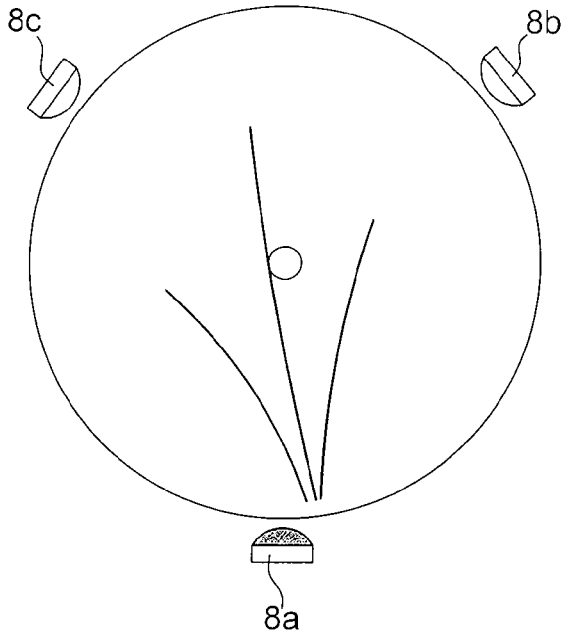
FIGS. 3*a*, 3*b*, 3*c* and 3*d* show schematically an example of images formed in succession to define an animated pattern.
Figure 3B:
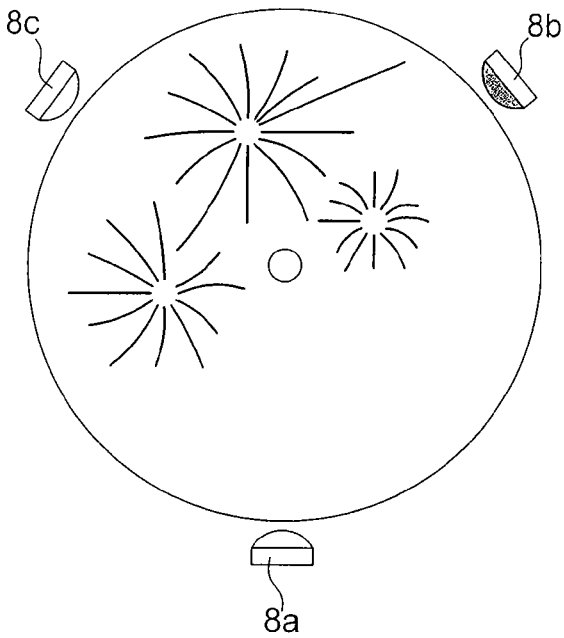
Figure 3C:
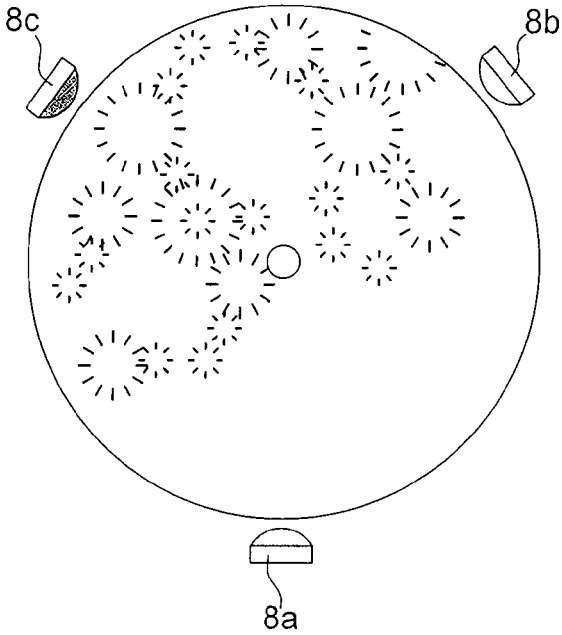

FIGS. 3*a* to 3*c* show schematically the figurative image formed by each of the three optical extractor networks cooperating with a given light source.

The timepiece corresponding to the diagrams of FIG. 3 includes three diodes 8, arranged substantially facing the 6 o'clock (reference 8*a* in FIG. 3), 2 o'clock (reference 8*b*) and 10 o'clock (reference 8*c*) positions.

Figure 3D:
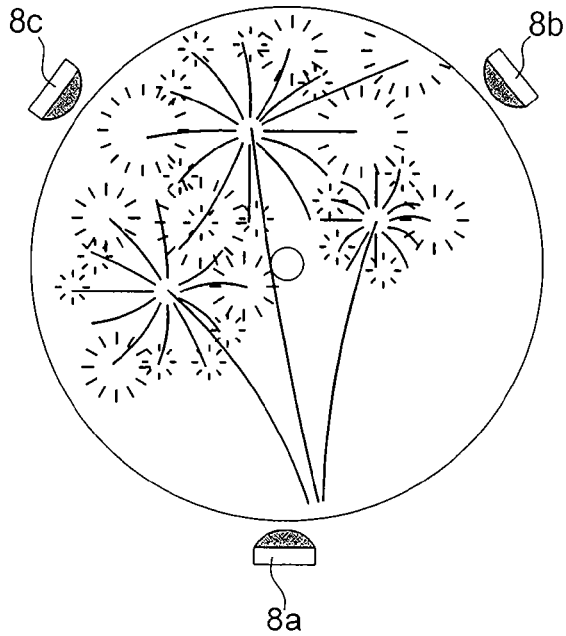

Each of diodes 8*a*, 8*b*, 8*c* is associated with a given optical extractor network. FIG. 3*a* shows the figurative image formed, as it appears to the person wearing the timepiece according to the present invention, when diode 8*a* is being powered to emit light in the direction of the network associated therewith. Likewise, FIGS. 3*b* and 3*c* show the figurative images respectively formed during operation of diodes 8*b* and 8*c*. FIG. 3*d* shows the multi-coloured figurative image formed when the three diodes 8*a*, 8*b* and 8*c* are simultaneously powered.

On the basis of this structure with three diodes and three interlaced optical extractors, a plurality of operating modes can be provided.

For example the electronic circuits of the watch can be programmed in accordance with the present invention such that the three diodes 8*a*, 8*b* and 8*c* are simultaneously powered in response to activation of a control member by the user. The corresponding function has an advantage beyond simply adding aesthetic appeal, in that the figurative image formed is luminous and can thus allow the person wearing the watch to identify the position of the hands when he is in a dark environment.

Alternatively or by way of complement, the electronic circuits of the watch can be programmed such that diodes 8*a*, 8*b* and 8*c* are powered sequentially in response to a different activation of the control member or in response to a different activation of an additional control member. It is clear that the present invention is not limited to the nature and operating modes of the control member or members.

By way of example, the three diodes could be simultaneously powered in response to a shock detected by an accelerometer arranged in the watch.

With a sequential type operating mode, a multi-coloured animation display is obtained, namely letting off fireworks in the case of the example shown in FIGS. 3*a* to 3*d*.

FIG. 3*a* shows a diagram of the display of the first figurative animation image, obtained by the collaboration of the light beams emitted by first diode 8*a* with a first optical extractor network. The person wearing the watch can see a luminous figurative image symbolising the trace left by rockets during a firework display from above the dial.

FIG. 3*b* shows a diagram of the display of the second figurative animation image obtained by the collaboration of the light beams emitted by second diode 8*b* with a second optical extractor network. The person wearing the watch can see a luminous figurative image symbolising the main explosions of rockets fired in the first step of the firework display.

FIG. 3*c* shows a diagram of the display of the third figurative animation image, obtained via the collaboration of the light beams emitted by the third diode 8*c* with a third optical extractor network. The person wearing the watch can see a luminous figurative image symbolising secondary rocket explosions.

Thus, when the three diodes 8*a*, 8*b* and 8*c* are powered sequentially, the person wearing the watch can see the firework being lit, followed by two series of explosions.

Those skilled in the art will of course be able to provide different variants of the animation that has just been described without departing from the scope of the present invention. For example, following the display of the third figuration image of the animation described hereinbefore, the three diodes 8*a*, 8*b* and 8*c* could be simultaneously powered to form the complete firework image.

Moreover, on the basis of the preceding description, a significant number of variants of the timepiece with a luminous pattern display according to the present invention can be provided.

By way of example, two optical extractor networks could be arranged on the same waveguide, wherein the light beams have different directions of reflection. In this case, two different figurative images are formed, visible from two different positions. According to an alternative embodiment, the two directions of direction could have an angle between them such that the two images formed constitute a stereogram when the observer's eyes are placed at a given distance above the optical guide.

Figure 4:
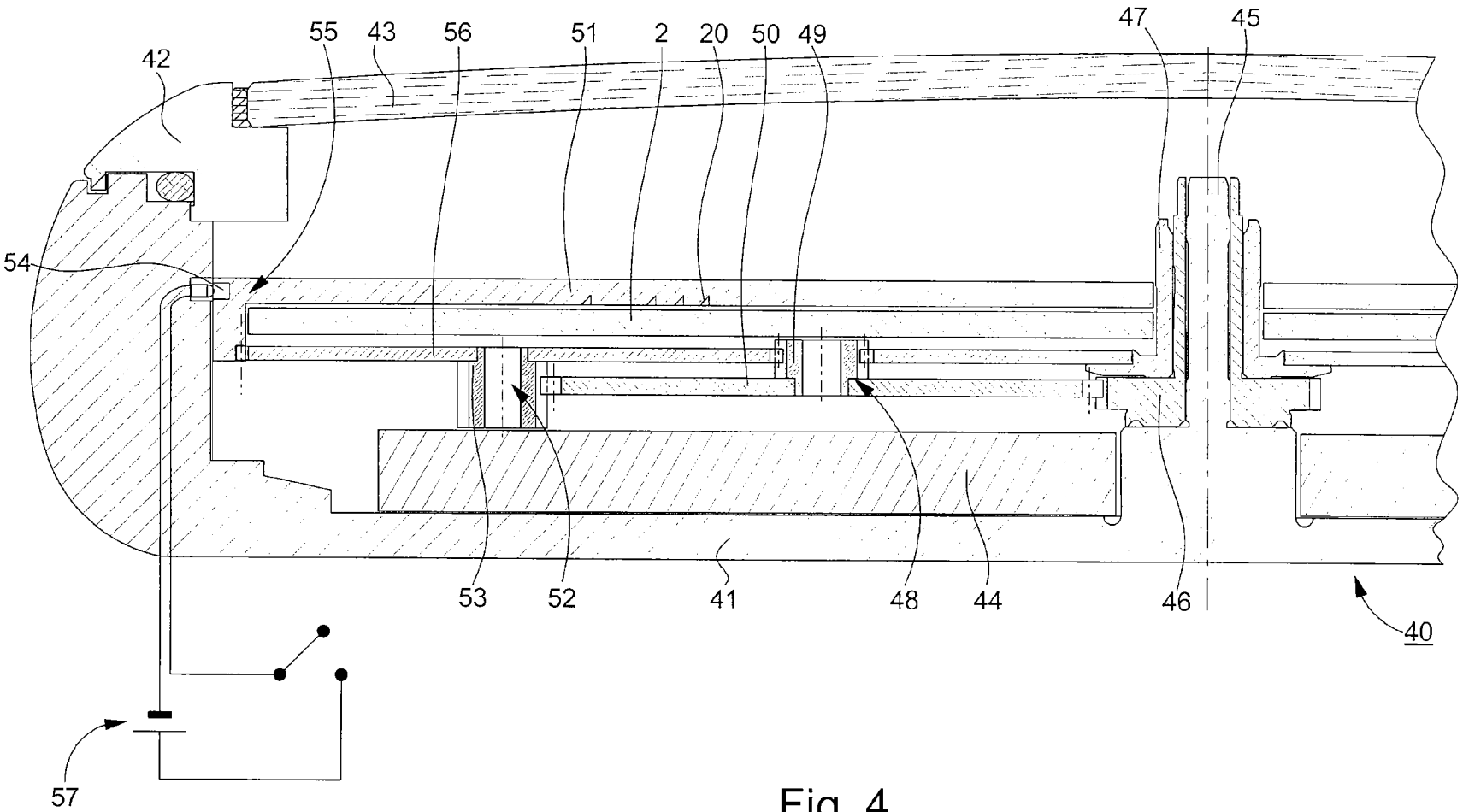
FIG. 4 shows a simplified cross-section of a timepiece according to a variant of the present invention.

A particular embodiment example is shown in FIG. 4, schematically, in the form of a partial transverse cross-section of a timepiece incorporating a luminous pattern display device according to the present invention. In this embodiment, an optical guide is driven in a movement of rotation about the minute and hour hand drive axis.

Electromechanical timepiece 40 includes a back cover-middle part 41, closed by a bezel 42 and a crystal 43. A conventional type of electronic movement has been represented by a block 44 to avoid overloading the diagram.

Back cover-middle part 41 can be made by plastic injection moulding, a central stud 45 being formed in one piece with the back cover-middle part, the main function of the latter being to carry the cannon-pinion 46 and the hour wheel 47. The cannon-pinion and the hour wheel are connected to each other conventionally via a motion work 48, formed by a minute pinion 49 and a minute wheel 50.

A dial 2 is mounted above these gear trains, and an optical guide 51 similar to optical guide 1 described in relation to the description of FIG. 1 is mounted above the dial. The dial and the optical guide can be centred by central stud 45 and/or held in their respective axial positions by conventional means (not shown), such as, for example, by resting on suitable shoulders of the middle part.

According to this embodiment, an additional intermediate wheel set 52 is provided, whose pinion 53 meshes with minute wheel 50.

Moreover, optical guide 51 has an annular shoulder 54 perpendicular to its large faces, arranged on the periphery of the optical guide and extending in the direction of the timepiece movement. The shoulder 54 carries a toothing 55 arranged on its inner surface to mesh with wheel 56 of intermediate wheel set 52. Because of this kinematic chain implemented between the cannon-pinion and the optical guide, the optical guide can be driven in rotation in the same rotational direction as the display hands (not shown). Thus, the kinematic chain may be considered as a means provided for driving the optical guide in rotation.

Further, at least one diode 8 is arranged in a suitable place in the middle part located opposite optical guide 51, electric connection means being provided to connect the electric terminals of the diode to the supply terminals of the battery (symbolised by the reference 57 in FIG. 4) used for the electric power supply of the timepiece. Diode 8 is advantageously arranged in an area of the middle part covered by the bezel to prevent it being visible through the timepiece crystal.

Preferably, four diodes 8 are arranged, respectively, between the 1 o'clock and 2 o'clock positions, between the 4 o'clock and 5 o'clock positions, between the 7 o'clock and 8 o'clock positions and between the 10 o'clock and 11 o'clock positions. One or several entry surfaces 9 similar to those described in relation to the description of FIG. 1 can be arranged at particular locations on the lateral face of optical guide 51. If four diodes are arranged in the timepiece, between one and four entry surfaces 9 are provided.

Further, the features of the kinematic chain responsible for driving the optical guide could be such that optical guide 51 is driven at the same speed as the minute hand.

On the basis of the structure described hereinbefore, various operating modes can be implemented as regards the formation of decorative patterns.

In a basic embodiment, one optical extractor network 20 can be arranged inside an area corresponding to a quadrant of the total surface of optical guide 51, the quadrant being for example arranged such that the minute hand forms the bisecting line thereof.

According to a preferred implementation, the four diodes 8 emit light beams in different colours.

When the quadrant bearing the optical extractor network, called the decorative quadrant, is centred opposite one of diodes 8, the latter being powered to emit light, a decorative pattern with maximum luminous intensity is obtained. When the decorative quadrant is in a different position from its centred position, as has just been described, the luminous intensity of the decorative pattern formed decreases as the quadrant moves away from its centred position.

Thus, the user can activate the decorative pattern display, for example by activating a control member, the colour and luminous intensity of the pattern depending upon the position of the minute hand with respect to the timepiece dial.

Of course, it is possible to omit entry surfaces 9 if one wishes to smoothen the variations in luminous intensity, i.e. in the latter case, transmission from a diode into the optical guide occurs in the same way whether the quadrant is in its centred position or not.

Conversely, when entry surfaces 9 are arranged in the lateral face of waveguide 51, light transmission is optimum from a diode to the inside of the optical guide when one of the entry surfaces is located opposite one of the diodes. When the optical guide is driven in rotation, the diode concerned is gradually located opposite the annular-shaped lateral face of the optical guide, the latter being less favourable to light transmission to the inside of the optical guide. The difference in light transmission quality inside the optical guide leads to a significant variation in the luminous intensity of the decorative pattern formed. The luminous intensity then progressively decreases while reflective surfaces 20 are oriented less and less opposite diode 8.

While the optical guide is rotating, the decorative quadrant moves closer to the next diode. Thus, when the latter is powered, the decorative pattern is formed with increasing luminous intensity progressively as the quadrant bisecting line moves closer to the diode.

The example that has just been described is presented by way of non-limiting example. Alternatively, the decorative pattern could cover a larger surface than one quadrant of the optical guide. Optical guide 51 could also include a plurality of optical extractor networks without departing from the scope of the present invention, like for example one network per quadrant allowing four decorative patterns to be simultaneously formed, the colour of each pattern being different from those of the other patterns.

However, a second optical guide (not shown) could also be provided, superposed on optical guide 51 and controlled by the rotation of the hour hand. For this purpose, an optical guide of this type can be directly driven onto the hour wheel pipe before setting the hour hand in place. Preferably, a set of additional diodes could be arranged in the middle part, opposite the additional optical guide.

Alternatively, the hour and minute hands could be replaced by rotating discs, in a known manner. In such case, the present invention is implemented by making the hour and minute indicating discs in the form of two optical guides. A first of these two optical guides includes a network of optical extractors, which, when they are illuminated, form a luminous pattern having the shape of an hour hand. The second optical guide includes a network of optical extractors, which when they are illuminated, form a luminous pattern having the shape of a minute hand. A set of three or four diodes regularly distributed around the watch dial can then be provided to illuminate the optical guides with a maximum of different incident directions.

Those skilled in the art will not encounter any difficulty in providing the number of diodes necessary for implementing the device according to the invention properly, in accordance with their requirements, and particularly as a function of the free space available underneath the bezel for arranging the diodes. It should be noted that from the point of view of electric power consumption and space, it is preferable to implement a single set of diodes, this being possible when the efficient light beam transmission height of a diode is sufficient to substantially cover the thickness of the two joined optical guides.

According to a variant shown in FIG. 2*b* is, for each light source a diode 8 is used, oriented orthogonally to a large face 11 of optical guide 1, i.e. it emits light rays directed overall vertically upwards, whereas in the embodiment shown in FIG. 2, diode 8 emits light rays directed overall orthogonally to large face 12.

Diode 8 is arranged here underneath optical guide 1, still in proximity to large face 12. Entry surface 9 is parallel here to the two large faces 10, 11. Preferably, the peripheral portion 60 of the top large face 10 of optical guide 1 is curved towards bottom large face 11 so that the light rays, which are emitted by diode 8 in the direction of the periphery of optical guide 1, can be totally reflected onto peripheral portion 60 and be directed towards reflective surfaces 20 associated with diode 8.

This variant enables "top emitting diodes" to be used, relative to the printed circuit board face on which they are mounted, as opposed to side emitting diodes.

From the point of view of the operation of the timepiece described hereinbefore, the diodes could be not powered permanently for energy saving reasons. Thus, the display of luminous patterns respectively having the form of the hour and minute hands can be controlled by the electronic circuits of the watch in response to the activation of a control member, for example. The timepiece then has an original and discreet appearance while offering excellent legibility when the diodes are being powered to implement the time display.

The preceding description corresponds to preferred embodiments of the invention and should in no way be considered limiting, more particularly as regards the structure described for the watch, the nature and number of control members used or the position of the diodes. Likewise, the invention is not limited to the operating modes described and means used for the respective actuation thereof insofar as such parameters can be altered by suitable programming of the controller circuit. Those skilled in the art will not encounter any particular difficulty in adapting the operation of the watch according to the present invention to fit their particular requirements. In particular, as suggested hereinbefore, each of the optical extractors can be made in the form of a raised portion having at least one light extraction surface through which light is refracted when it leaves the optical guide.

Figure 5:
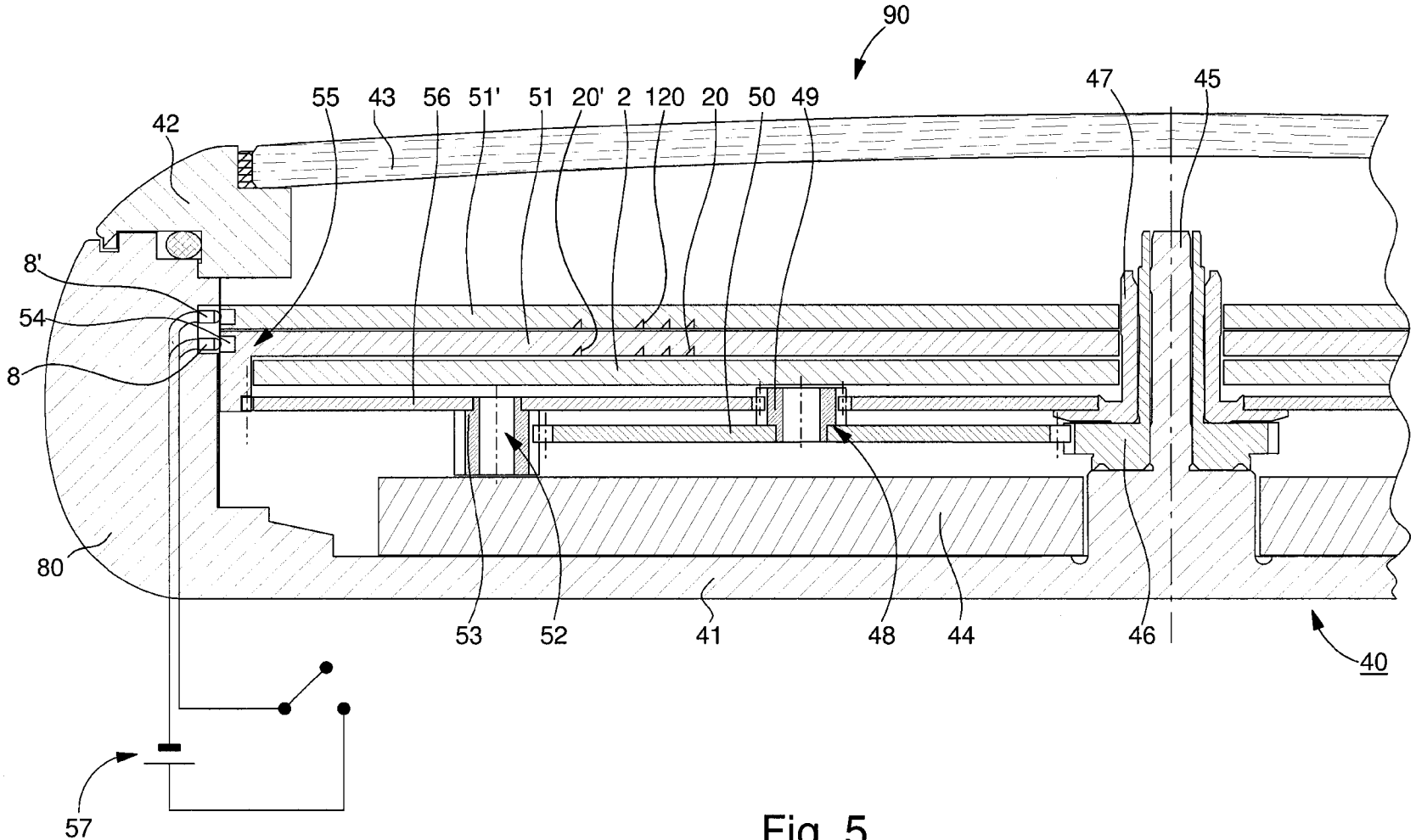
FIG. 5 shows a simplified cross-section of a timepiece according to another variant of the present invention.

One particular variant of the invention is shown in FIG. 5, and pertains to a timepiece 90 that includes a case 80 closed by a crystal 43, and inside which there is housed an optical device for forming at least one figurative image through the crystal 43, wherein the optical device includes, on the one hand, at least one optical guide having two large faces and at least one lateral face and, on the other hand, at least one light source 8, 8', which emits light inside the optical guide, of the type in which the light emitted by the light source cooperates with optical extractors that are arranged on one of the large faces to form the figurative image, wherein the light source is arranged in proximity to the lateral face and oriented in a predefined direction to emit light inside the optical guide, wherein each optical extractor has predefined geometrical features, including at least one reflective or refractive surface, such that the set of light beams emitted by the light source that are reflected or refracted respectively, by the optical extractors forms a light beam network that generates the figurative image, and wherein the optical guide performs the function of a crystal. In accordance with the embodiment shown in FIG. 5, the optical guide includes at least two groups of optical extractors 20, 20' corresponding to a first figurative image and a second group of optical extractors 120 corresponding to a second figurative image, and the second group of optical extractors 120 is arranged in a second optical guide 51' superposed onto the first optical guide 51.

Figure 6:
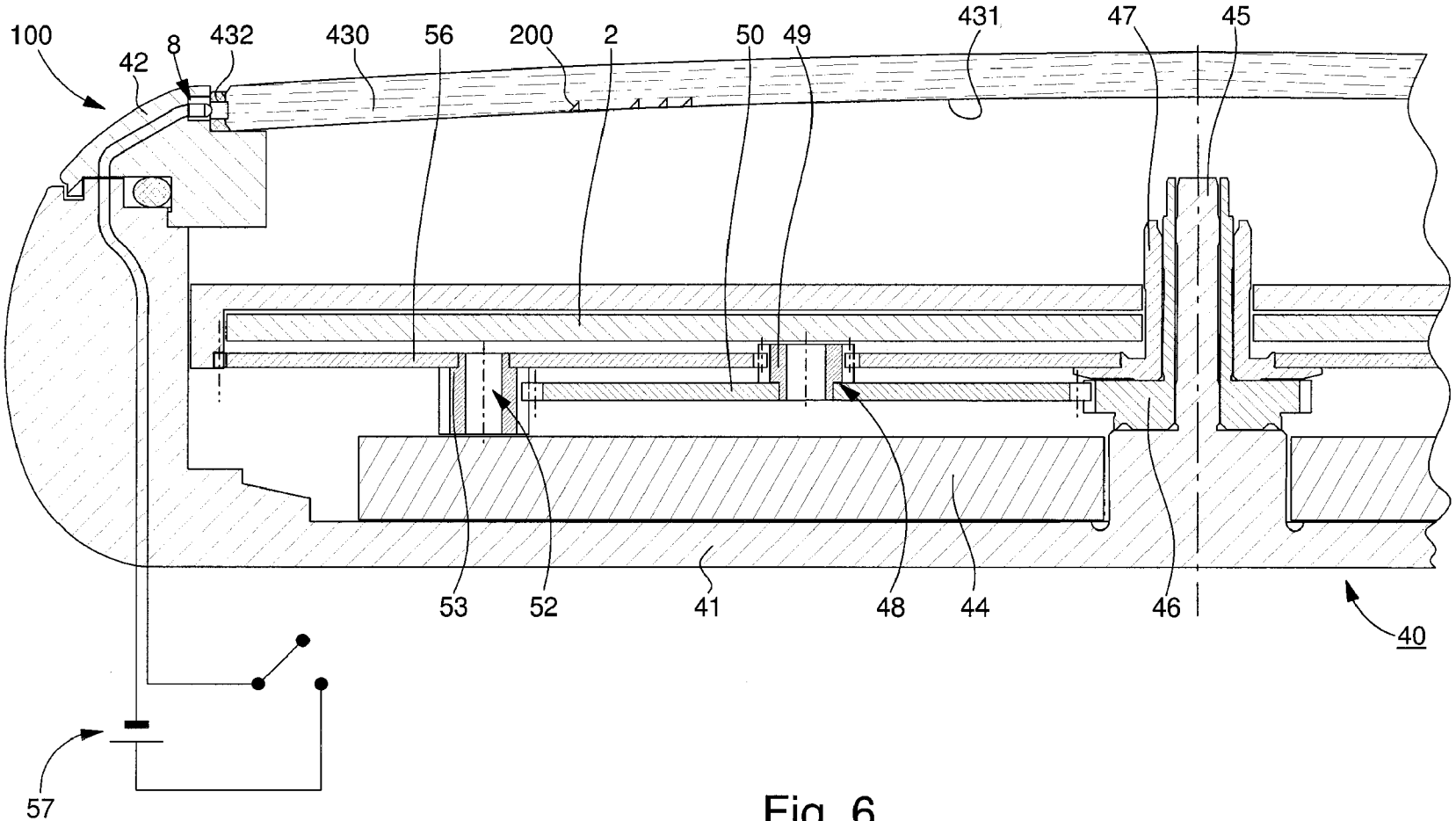
FIG. 6 shows a simplified cross-section of a timepiece according to yet another variant of the present invention.

Numerous other variants can be implemented without departing from the scope of the present invention, such as not arranging a dial in the watch, the optical guide performing this function directly and the hand drive trains being adapted to have an attractive appearance for the person wearing the watch. Along the same lines, the optical guide could be directly formed by the watch crystal as shown in FIG. 6. In such a case as shown in FIG. 6, the crystal 430 includes optical extractors 200 arranged in its inner face 431, one or several light sources 8 being arranged in the bezel area 100 so as to emit light beams in the direction of the edge 432 of the crystal 430.

Additional features could also be provided without departing from the scope of the present invention, such as for example covering the lateral face of the optical guide with a reflective coating, outside the entry surfaces, to limit losses of light due to light beams reaching the lateral face and being liable to leave the optical guide.

What is claimed is:

1. A timepiece including:

(a) a case closed by a crystal, and inside the case there is housed an optical device for forming at least one complete figurative image through the crystal, wherein the optical device includes i. at least one optical waveguide made of a solid material and having two large faces and at least one lateral face; and ii. at least one light source that emits light inside the optical waveguide, wherein the light emitted by the light source cooperates with optical extractors that are arranged on one of the two large faces of the optical waveguide to form the complete figurative image, wherein the complete figurative image includes a first figurative image and a second figurative image, wherein the light source is arranged in proximity to the at least one lateral face and the light source is oriented in a predefined direction to emit light inside the optical waveguide, wherein each optical extractor has predefined geometrical features, including at least one reflective or refractive surface, so that a set of light beams emitted by the light source are reflected or refracted, respectively, by the optical extractors to form a light beam network that generates the complete figurative image, and wherein the crystal includes an edge and an inner face, wherein the optical waveguide is arranged on the inner face of the crystal, wherein the at least one light source of the timepiece includes a first light source and at least a second light source arranged for emitting light inside the optical waveguide along a different direction from an emission direction of the first light source; and (b) a dial housed inside the case, wherein the at least one optical waveguide is disposed between the dial and the crystal, and the optical waveguide includes a first group of optical extractors corresponding to the first figurative image and a second group of optical extractors corresponding to the second figurative image; and (c) means for driving the optical waveguide in rotation so that the first group of optical extractors cooperate alternately with the first light source and the second light source.

2. The timepiece according to claim 1, wherein the light source is arranged facing the lateral face in a predefined direction for emitting light inside the optical waveguide and cooperating with the reflective or refractive surfaces to form the complete figurative image.

3. The timepiece according to claim 1, wherein the light source is oriented in an orthogonal direction to one of the large faces.

4. The timepiece according to claim 1, wherein the first light source is arranged for cooperating with the first group of optical extractors, and the second light source is arranged for cooperating with the second group of optical extractors, and wherein said first and second groups of optical extractors are interlaced on said large face of the optical waveguide.

5. The timepiece according to claim 1, wherein the first light source is arranged for cooperating with the first group of optical extractors, and the second light source is arranged for cooperating with the second group of optical extractors.

6. The timepiece according to claim 5, wherein the two light sources are powered sequentially.

7. The timepiece according to claim 5, wherein each light source is capable of emitting light in several colour ranges.

8. The timepiece according to claim 5, wherein the respective colours of said first and second light sources belong to different ranges.

9. The timepiece according to claim 1, wherein respective geometrical features of the first group of optical extractors and the second group of optical extractors are defined so that the associated first and second figurative images are formed in different respective directions.

10. The timepiece according to claim 9, wherein said different figurative image forming directions are defined so as to form a stereogram.

11. The timepiece according to claim 1, wherein the case has a bezel, and each of the first light source and the at least a second light source is arranged at least partially underneath the bezel.

12. The timepiece according to claim 1, wherein the solid material of the optical waveguide is a transparent plastic material.

13. A timepiece including:

(a) a case closed by a crystal, wherein the crystal comprises an optical device for forming at least one figurative image through the crystal, wherein the optical device includes i. at least one optical waveguide having two large faces and at least one lateral face; and ii. at least one light source that emits light inside the optical waveguide, wherein the light emitted by the light source cooperates with optical extractors that are arranged on one of the two large faces of the optical waveguide to form the figurative image, wherein the light source is arranged in proximity to the at least one lateral face and the light source is oriented in a predefined direction to emit light inside the optical waveguide, wherein each optical extractor has predefined geometrical features, including at least one reflective or refractive surface, so that a set of light beams emitted by the light source are reflected or refracted, respectively, by the optical extractors to form a light beam network that generates the figurative image, and wherein the crystal includes an edge and an inner face, wherein the at least one optical waveguide is formed by the crystal and the optical extractors of the optical waveguide are arranged in the inner face of the crystal.

14. The timepiece according to claim 13, wherein the at least one light source is arranged so as to emit light beams in the direction of the edge of the crystal.

15. A timepiece including:

(a) a case closed by a crystal, and inside the case there is housed an optical device for forming at least one figurative image through the crystal, wherein the optical device includes i. at least one optical waveguide made of a solid material and having two large faces and at least one lateral face; and ii. at least one light source that emits light inside the optical waveguide, wherein the light emitted by the light source cooperates with optical extractors that are arranged on one of the two large faces of the optical waveguide to form the at least one figurative image, wherein the optical waveguide includes at least a first group of optical extractors corresponding to a first figurative image and a second group of optical extractors corresponding to a second figurative image, wherein the light source is arranged in proximity to the at least one lateral face and the light source is oriented in a predefined direction to emit light inside the optical waveguide, wherein each optical extractor has predefined geometrical features, including at least one reflective or refractive surface, so that a set of light beams emitted by the light source are reflected or refracted, respectively, by the optical extractors to form a light beam network that generates the at least one figurative image, and wherein the crystal includes an edge and an inner face, wherein the optical extractors of the optical waveguide are arranged on the inner face of the crystal, and wherein the at least one light source of the timepiece includes a first light source arranged for cooperating with the first group of optical extractors, and a second light source arranged for cooperating with the second group of optical extractors, wherein the second light source is arranged for emitting light inside the optical waveguide along a different direction from an emission direction of the first light source, and the timepiece additionally includes (b) means for driving the optical waveguide in rotation so that the optical extractors cooperate alternately with the first light source and the second light source.

16. The timepiece according to claim 15, wherein the solid material of the optical waveguide is a transparent plastic material.

* * * * *